US010841690B2

(12) United States Patent
Kobayashi et al.

(10) Patent No.: US 10,841,690 B2
(45) Date of Patent: Nov. 17, 2020

(54) SOUND REPRODUCING APPARATUS, SOUND REPRODUCING METHOD, AND COMPUTER READABLE STORAGE MEDIUM

(71) Applicant: ASAHI KASEI KABUSHIKI KAISHA, Tokyo (JP)

(72) Inventors: Shiro Kobayashi, Menlo Park, CA (US); Masaya Yamashita, Tokyo (JP); Takeshi Ishii, Tokyo (JP); Soichi Mejima, New York, NY (US)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/370,639

(22) Filed: Mar. 29, 2019

(65) Prior Publication Data

US 2020/0314534 A1 Oct. 1, 2020

(51) Int. Cl.

| | |
|---|---|
| ***H04R 1/32*** | (2006.01) |
| ***G10K 11/178*** | (2006.01) |
| ***H04R 29/00*** | (2006.01) |
| ***H04S 7/00*** | (2006.01) |
| ***H04R 1/40*** | (2006.01) |

(52) U.S. Cl.

CPC ..... *H04R 1/323* (2013.01); *G10K 11/178* (2013.01); *H04R 29/002* (2013.01); *H04S 7/303* (2013.01); *H04R 1/403* (2013.01); *H04R 2201/401* (2013.01); *H04R 2203/00* (2013.01); *H04R 2217/03* (2013.01); *H04R 2430/20* (2013.01)

(58) Field of Classification Search

CPC ..... H04R 1/323; H04R 1/403; H04R 29/002; H04R 2201/401; H04R 2203/00; H04R 2217/03; H04R 2430/20; G10K 11/178; H04S 7/302; H04S 7/303

USPC ..... 381/57, 79, 82, 107

See application file for complete search history.

(56) References Cited

U.S. PATENT DOCUMENTS

| | | | |
|---|---|---|---|
| 9,392,389 | B2 | 7/2016 | Hall et al. |
| 9,602,916 | B2 | 3/2017 | Asada |

(Continued)

FOREIGN PATENT DOCUMENTS

| | | | |
|---|---|---|---|
| JP | H05150792 | A | 6/1993 |
| JP | 2009111833 | A | 5/2009 |

(Continued)

*Primary Examiner* — Jesse A Elbin

(74) *Attorney, Agent, or Firm* — Kenja IP Law PC

(57) ABSTRACT

A sound reproducing apparatus and a sound reproducing method are provided. The apparatus includes a noise assessment unit configured to assess an intensity of ambient sound, a processor that determines an omnidirectional audio output level based on the intensity of ambient sound, an omnidirectional speaker configured to reproduce a desired sound at the omnidirectional audio output level, and a directional speaker configured to reproduce the desired sound simultaneously with the omnidirectional speaker. The method includes the steps of assessing an intensity of ambient sound, determining an omnidirectional audio output level based on the intensity of ambient sound, and reproducing a desired sound simultaneously from an omnidirectional speaker and a directional speaker. The omnidirectional speaker is controlled to reproduce the desired sound at the omnidirectional audio output level.

16 Claims, 4 Drawing Sheets

(56) References Cited

U.S. PATENT DOCUMENTS

| | | | | |
|---|---|---|---|---|
| 10,134,416 | B2 * | 11/2018 | Florencio | G10K 11/002 |
| 2005/0216339 | A1 * | 9/2005 | Brazell | G06Q 30/02 705/14.52 |
| 2006/0149632 | A1 * | 7/2006 | Register | G06Q 30/02 705/14.27 |
| 2013/0058503 | A1 | 3/2013 | Kato et al. | |
| 2013/0136266 | A1 * | 5/2013 | McClain | H03G 3/32 381/57 |
| 2015/0346845 | A1 | 12/2015 | Di Censo et al. | |
| 2016/0173049 | A1 * | 6/2016 | Mehta | H03G 3/32 381/57 |
| 2019/0349680 | A1 * | 11/2019 | Sculley | H04S 7/302 |

FOREIGN PATENT DOCUMENTS

| | | | |
|---|---|---|---|
| JP | 2013057705 | A | 3/2013 |
| JP | 2013251751 | A | 12/2013 |
| JP | 2017191967 | A | 10/2017 |
| JP | 2018107678 | A | 7/2018 |
| WO | 2018016432 | A1 | 1/2018 |

* cited by examiner

SOUND REPRODUCING APPARATUS, SOUND REPRODUCING METHOD, AND COMPUTER READABLE STORAGE MEDIUM

TECHNICAL FIELD

The present disclosure relates to a sound reproducing apparatus, a sound reproducing method, and a computer readable storage medium.

BACKGROUND

Directional audio systems, also known as parametric acoustic arrays, have been used in many practical audio applications. The directional audio systems often use ultrasound waves to transmit audio in a directed beam of sound. Ultrasound waves have much smaller wavelengths than regular audible sound and thus the directional audio systems become much more directional than traditional loudspeaker systems. Due to their high directivity, the directional audio systems have been used in exhibitions, galleries, museums, and the like to provide audio information that is audible only to a person in a specific area. For example, U.S. Pat. No. 9,392,389 discloses a system for providing an audio notification to a listener via a dual-mode speaker system that is selectively operable in an omnidirectional broadcast mode and in a directional broadcast mode. This system selects the broadcast mode based on the audio notification condition. For example, in the directional broadcast mode, specific information is delivered to a specific person, while, in the omnidirectional broadcast mode, general information such as a weather alert is delivered to all persons.

SUMMARY

Retailers such as department stores, drug stores, and supermarkets often arrange similar products on long shelves separated by aisles. Shoppers walk through the aisles while searching products they need. Sales of the similar products depend greatly on the ability of the product to catch the shopper's eye and on product placement.

However, due to limitations of conventional product packaging, there has been demands for more effective ways to draw the shopper's attention to a specific product associated with the shopper's interest.

It may be possible to use the directional audio systems to provide product information to the shoppers. Since the spaces of the retailers are not always quiet and levels of environmental and background noises are often high, a high acoustic sound pressure level is required for the directional audio system. However, the audio output level of a transducer used in parametric acoustic arrays directional audio systems is very limited and a number of transducers are required to achieve the desired acoustic sound pressure level, which is practically not viable in terms of a cost and a size.

It is, therefore, an object of the present disclosure to provide a sound reproducing apparatus, a sound reproducing method, and a computer readable non-transitory storage medium, which can distribute a desired sound to a person in a specific area even in a noisy environment.

In order to achieve the object, one aspect of the present disclosure is a sound reproducing apparatus comprising:

a noise assessment unit configured to assess an intensity of ambient sound;

a processor that determines an omnidirectional audio output level based on the intensity of ambient sound;

an omnidirectional speaker configured to reproduce a desired sound at the omnidirectional audio output level; and a directional speaker configured to reproduce the desired sound simultaneously with the omnidirectional speaker.

Another aspect of the present disclosure is a sound reproducing method comprising:

assessing an intensity of ambient sound;

determining an omnidirectional audio output level based on the intensity of ambient sound; and reproducing a desired sound simultaneously from an omnidirectional speaker and a directional speaker, wherein the omnidirectional speaker is controlled to reproduce the desired sound at omnidirectional audio output level.

Yet another aspect of the present disclosure is a computer readable non-transitory storage medium storing a program that, when executed by a computer, cause the computer to perform operations comprising:

assessing an intensity of ambient sound;

determining an omnidirectional audio output level based on the intensity of ambient sound; and reproducing a desired sound simultaneously from an omnidirectional speaker and a directional speaker, wherein the omnidirectional speaker is controlled to reproduce the desired sound at the omnidirectional audio output level.

According to the sound reproducing apparatus, the sound reproducing method, and the computer-readable non-transitory storage medium of the present disclosure, it is possible to effectively distribute a desired sound to a person in a specific area even in a noisy environment.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION

Figure 1:
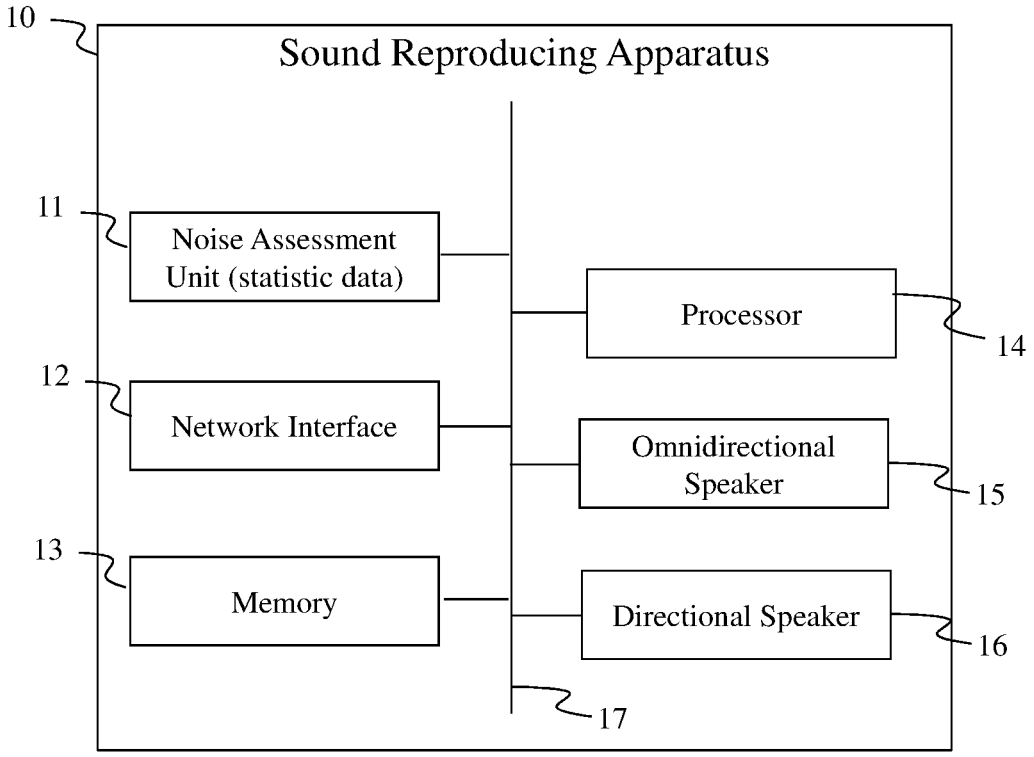
FIG. 1 is a block diagram of a sound reproducing apparatus according to an embodiment of the present disclosure.

Embodiments will now be described with reference to the drawings. FIG. 1 is a block diagram of a block diagram of a sound reproducing apparatus 10 according to an embodiment of the present disclosure.

(Configuration of the Sound Reproducing Apparatus 10)

The sound reproducing apparatus 10 is used to deliver a desired sound to a person in a specific area and includes a noise assessment unit 11, a processor 14, an omnidirectional speaker 15, and a directional speaker 15 which are electrically connected with each other via a bus 17. In this embodiment, the sound reproducing apparatus 10 further include a network interface 12, and a memory 13, which are not essential for the present disclosure.

The noise assessment unit 11 is configured to assess an intensity of ambient sound in the specific area to which the desired sound is delivered. The noise assessment unit 11 may include one or more microphone for measuring the actual intensity of ambient sound. The microphone may be omnidirectional, unidirectional or bi-directional. When more than one microphones are used, the same or different types of microphones may be used. For example, the noise assessment unit 11 may include an omnidirectional microphone which is used to collect general background noise and a unidirectional microphone which is used to collect noise from a specific sound source. Alternatively, the noise assessment unit 11 may include statistical data of the intensity of ambient sound and estimate the intensity of ambient sound by looking up the statistical data according to the day and time. In some cases, the main source of ambient sound is background music (environmental music) reproduced from other speakers. In this instance, the intensity of the reproduced music is known and thus may be used as the intensity of ambient sound. The intensity of ambient sound decided by the noise assessment unit 11 is sent to the processor 14.

The network interface 12 includes a communication module that connects the sound reproducing apparatus 10 to a network. The network is not limited to a particular communication network and may include any communication network including, for example, a mobile communication network and the internet. The network interface 12 may include a communication module compatible with mobile communication standards such as 4th Generation (4G) and 5th Generation (5G). The communication network may be an ad hoc network, a local area network (LAN), a metropolitan area network (MAN), a wireless personal area network (WPAN), a public switched telephone network (PSTN), a terrestrial wireless network, an optical network, or any combination thereof.

The memory 13 includes, for example, a semiconductor memory, a magnetic memory, or an optical memory. The memory 13 is not particularly limited to these, and may include any of long-term storage, short-term storage, volatile, non-volatile and other memories. Further, the number of memory modules serving as the memory 13 and the type of medium on which information is stored are not limited. The memory may function as, for example, a main storage device, a supplemental storage device, or a cache memory. The memory 13 also stores any information used for the operation of the sound reproducing apparatus 10. For example, the memory 13 may store the above-mentioned statistical data of the intensity of ambient sound, a system program and/or an application program. The information stored in the memory 13 may be updatable by, for example, information acquired from an external device by the network interface 12.

The processor 14 may be, but not limited to, a general-purpose processor or a dedicated processor specialized for a specific process. The processor 14 includes a microprocessor, a central processing unit (CPU), an application specific integrated circuit (ASIC), a digital signal processor (DSP), a programmable logic device (PLD), a field programmable gate array (FPGA), a controller, a microcontroller, and any combination thereof. The processor 14 controls the overall operation of the sound reproducing apparatus 10.

For example, the processor 14 may determine an omnidirectional audio output level based on the intensity of ambient sound sent from the noise assessment unit 11. Specifically, the processor 14 compares the intensity of ambient sound with a given threshold, which may be stored in the memory 13, and determines the omnidirectional audio output level, for example, by the following procedure.

If the intensity of ambient sound is equal to or higher than the given threshold, the processor 14 sets the omnidirectional audio output level to a high-level VOL_HIGH. If the intensity of ambient sound is lower than the given threshold, the processor 14 sets the omnidirectional audio output level to a low-level VOL_LOW which is lower than VOL-HIGH. The output levels VOL-HIGH and VOL-LOW may be arbitrarily determined depending on the sizes of the omnidirectional and directional speakers, the distance between the speakers and the specific area to which the desired sound is delivered, the dimension of the space where the sound is reproduces and the like. Two or more threshold may be used and consequently three or more omnidirectional audio output levels may be used. The lowest omnidirectional audio output level may be subaudible.

Alternatively, the processor 14 may change an omnidirectional audio output level in proportion the intensity of ambient sound sent from the noise assessment unit 11. In other words, the omnidirectional audio output level continuously varies along with the intensity of ambient sound. The processor 14 may also calculates an output from the omnidirectional speaker required to attenuate the influence of ambient sound and use the calculated output as the omnidirectional audio output level.

The processor also selects the desired sound or the sound contents. The sound contents may be stored in the memory 13 or may be streamed on demand from an external device via the network interface 12.

The omnidirectional speaker 15 may be any type of loudspeakers including horns, electrodynamic loudspeakers, flat panel speakers, plasma arc speakers, and piezoelectric speakers, and radiates sound in all directions. The output level of the omnidirectional speaker 15 is controlled at the omnidirectional audio output level by the processor 14.

The directional speaker 16 emits ultrasound waves in a beam direction. The beam direction may be adjusted by the processor 14 to emits the ultrasound waves to a target object. When the target object is hit by the ultrasound waves, it reflects the ultrasound waves to generate an audible sound. The directional speaker 16 may include an array of ultrasound transducers to implement a parametric array. The parametric array consists of a plurality of ultrasound transducers and amplitude-modulates the ultrasound waves based on the desired audible sound. Each transducer projects a narrow beam of modulated ultrasound waves at high energy level to substantially change the speed of sound in the air that it passes through. The air within the beam behaves nonlinearly and extracts the modulation signal from the ultrasound waves, resulting in the audible sound appearing from the surface of the target object which the beam strikes. This allows a beam of sound to be projected over a long distance and to be heard only within a limited area. The beam direction of the directional speaker 16 may be adjusted by controlling the parametric array and/or actuating the orientation/attitude of the emitter.

(Operation of the Sound Reproducing Apparatus 10)

Figure 2:
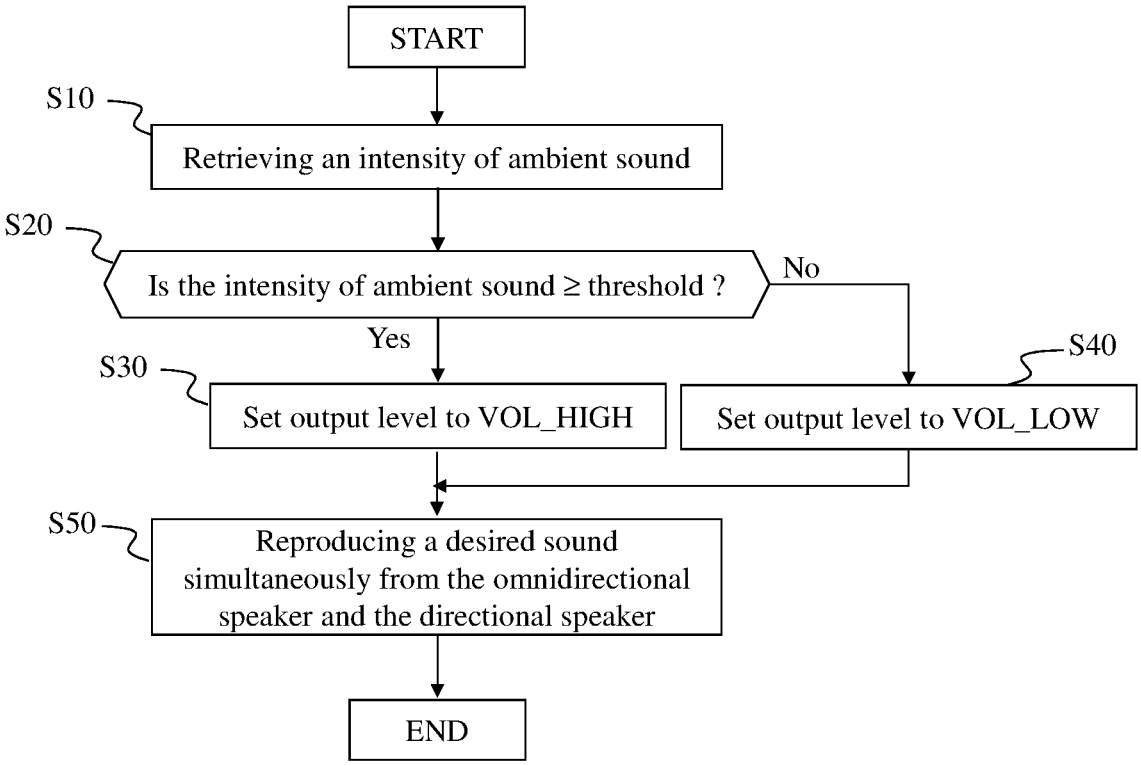
FIG. 2 is a schematic diagram showing a general flow of an operation of the sound reproducing apparatus according to an embodiment of the present disclosure.

Referring now to FIG. 2, the operation of the sound reproducing apparatus 10 will be discussed.

At step S10, the noise assessment unit 11 assesses an intensity of ambient sound in the specific area to which the desired sound is delivered. Specifically, the noise assessment unit 11 has statistical data of the intensity of ambient noise and retrieve the intensity of ambient noise corresponding to the current date and time from the statistical data. For example, retailers are generally crowded during the weekend and between 4 pm and 7 pm on weekdays. Thus, the intensity of ambient noise corresponding to these time slots are higher than other time slots.

The processor 14 receives the intensity of ambient sound from the noise assessment unit 11 and compares it with a given threshold, at step S20. If the intensity of ambient sound is equal to or higher than the given threshold, the operation proceeds to step S30. If the intensity of ambient sound is lower than the given threshold, the operation proceeds to step S40.

At step S30, the processor 14 sets the omnidirectional audio output level to a high-level VOL_HIGH. In other words, the output level higher than when the intensity of ambient sound is lower than the given threshold is assigned to the of the omnidirectional speaker 15.

Alternatively, at step S40, the processor 14 sets the omnidirectional audio output level to a low-level VOL_LOW. In other words, the output level lower than when the intensity of ambient sound is equal to or higher than the given threshold is assigned to the of the omnidirectional speaker 15.

Then, at step S50, the processor 14 drive the omnidirectional speaker 15 to reproduce the sound content at the omnidirectional audio output level. Simultaneously, the processor 14 drives the directional speaker 16 so as to transmit the sound content in a form of a directed beam of ultrasound waves.

Upon being struck by the beam, the target object generates an audible sound. The omnidirectional audio output level is set to be low enough so that the sound reproduced from the omnidirectional speaker 15 alone is easily mixed with the ambient sound and thus is not clearly recognizable. The omnidirectional audio output level is also set to be high enough so that the sound content is recognizable when the sound reproduced from the omnidirectional speaker 15 and the sound generated from the ultrasound waved emitted by the directional speaker 16 are superimposed. In this way, only a person in the specific area to which the directional speaker 16 is oriented can recognize the sound content and people outside the specific area cannot listen the sound content.

Figure 3:
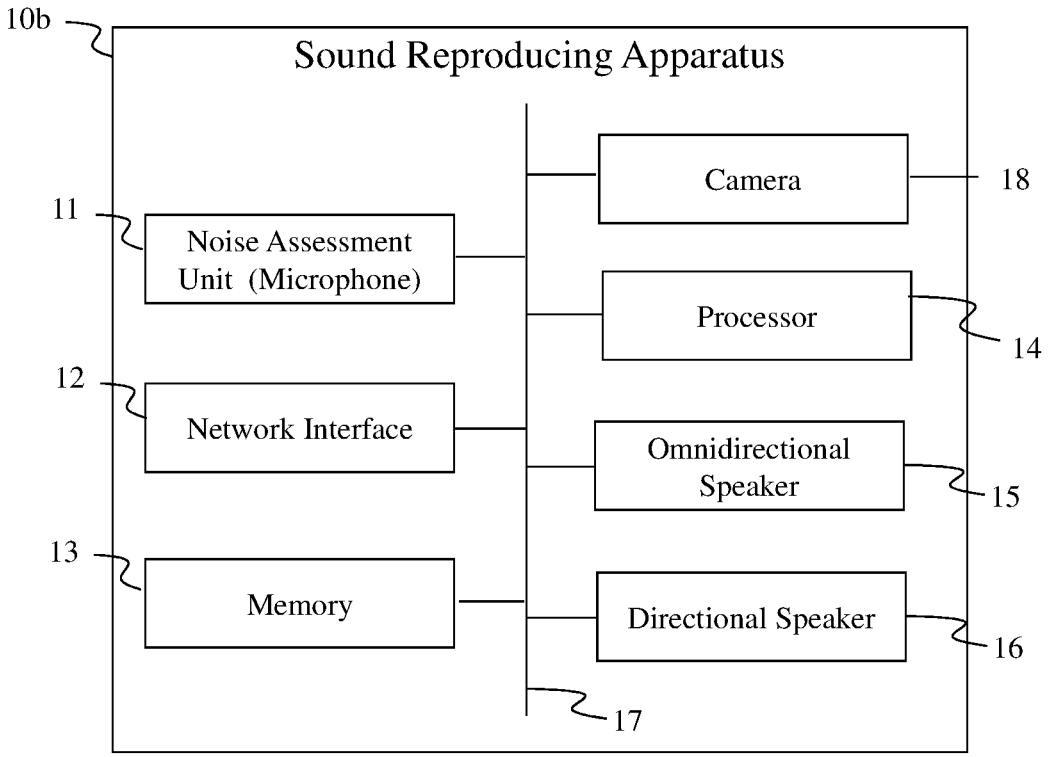
FIG. 3 is a block diagram of a sound reproducing apparatus according to another embodiment of the present disclosure.

FIG. 3 is a block diagram of a sound reproducing apparatus according to another embodiment of the present disclosure. In principle, like components are denoted by like reference numerals, and the description of those components will not be repeated.

(Configuration of the Sound Reproducing Apparatus 10*b*) In this embodiment, the noise assessment unit 11 includes a microphone. A camera 18 is provided to captures an image of a listener at a predetermined screen resolution and a predetermined frame rate. The camera 18 may be a 2D camera, a 3D camera, and an infrared camera. The captured image is transmitted to the processor 14 via the bus 17. The predetermined screen resolution is, for example, full high-definition (FHD; 1920*1080 pixels), but may be another resolution as long as the captured image is appropriate to the subsequent image recognition processing. The predetermined frame rate may be, but not limited to, 30 fps.

The processor 14 uses the captured image of the listener to extract attribute information of the listener. The attribute information is any information representing the attributes of the listener, and includes gender, age group, height, body type, hairstyle, clothes, emotion, belongings, head orientation, gaze direction, and the like of the listener. The processor 14 may perform an image recognition processing on the image information to extract at least one type of the attribute information of the listener. The processor 14 may also determine the sound contents based on the attribute information obtained from image recognition processing. As the image recognition processing, various image recognition methods that have been proposed in the art may be used. For example, the processor 14 may analyze the image information by an image recognition method based on machine learning such as a neural network or deep learning. Data used in the image recognition processing may be stored in the memory 13. Alternatively, data used in the image recognition processing may be stored in a storage of an external device (hereinafter referred simply as the "external device") accessible via the network interface 12.

The image recognition processing may be performed on the external device. Also, the determination of the target object may be performed on the external device. In these cases, the processor 14 transmits the captured image to the external device via the network interface 12. The external device extracts the attribute information from the captured image and determines the sound contents based on the attribute information. Then, the attribute information and the sound contents are transmitted from the external device to the processor 14 via the network interface 12.

Figure 4:
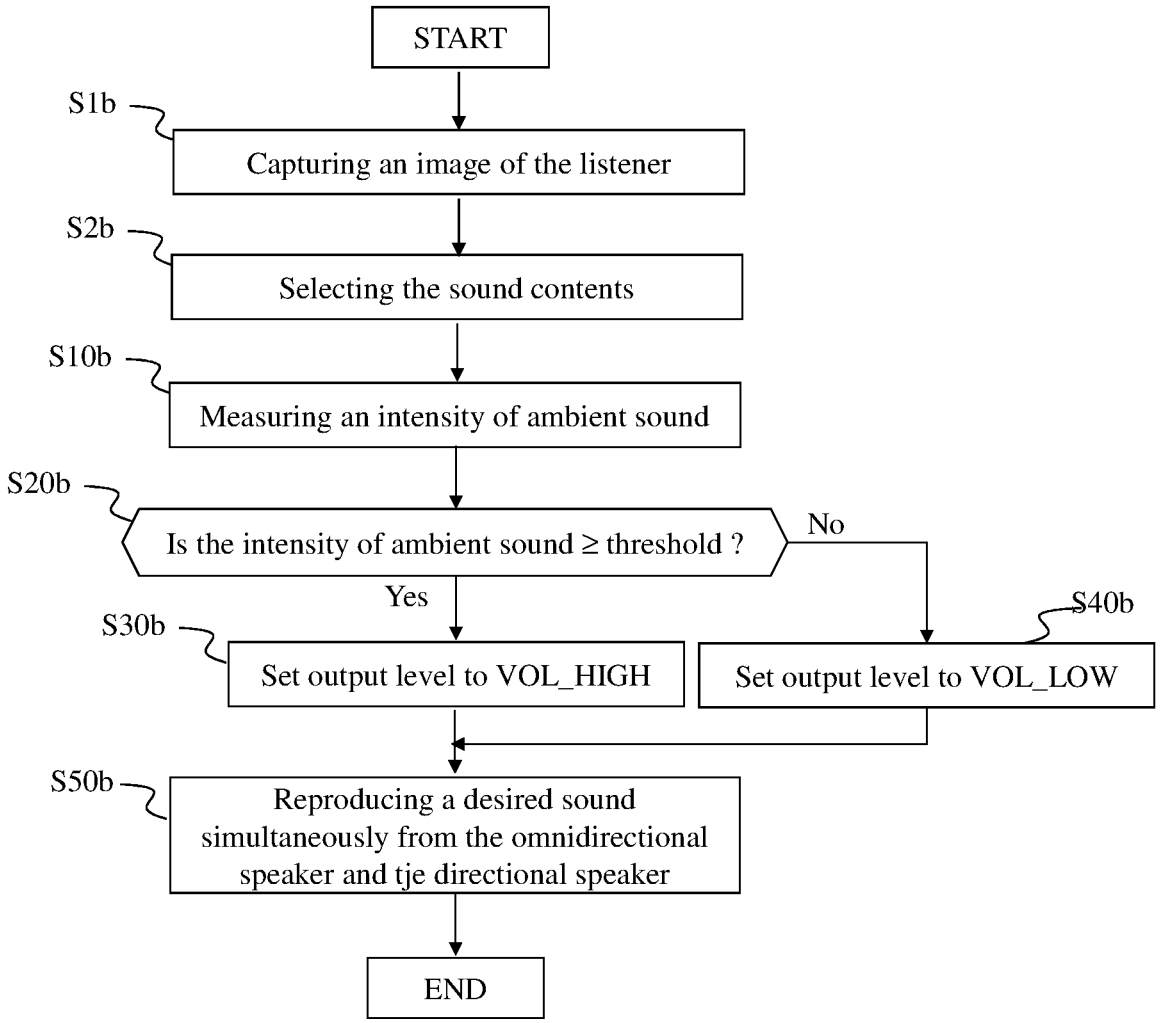
FIG. 4 is a schematic diagram showing a general flow of an operation of the sound reproducing apparatus according to another embodiment of the present disclosure.

(Operation of the Sound Reproducing Apparatus 10*b*) Referring now to FIG. 4, the operation of the sound reproducing apparatus 10 will be discussed.

At step S1*b*, the camera 18 captures an image of a listener and sends it to the processor 14. The captured image is sent to the processor 14.

At step S2*b*, the processor 14 extracts attribute information of the listener from the captured image. The processor 14 may perform an image recognition processing on the captured image to extract one or more types of the attribute information of the listener. Then, the processor 14 selects the sound contents based on the extracted attribute information. For example, the processor 14 searches information relating to the extracted attributes from a database. For example, when the extracted attributes are "female" and "age in 40s" and a food wrap is most often bought by people belonging to female in 40s, the processor 14 retrieves audio data of the sound contents associated with the food wrap. The sound contents may be a human voice explaining the detail of the product or a song used in a TV commercial of the product.

A single type of audio data may be prepared for each product. Alternatively, multiple types of audio data may be prepared for a single product and be selected based on the attribute information.

The processor 14 may communicate with the external device via the network interface 12 to get the supplemental information. The supplemental information may be any information useful to determine the sound contents, such as weather condition, season, temperature, humidity, current time, product sale information, product price information, product inventory information, news information, and the like. The processor 14 may take the supplemental information into consideration for selecting the sound contents.

At step S10*b*, the microphone of the noise assessment unit 11 collects ambient sound in the specific area to which the desired sound is delivered, and the noise assessment unit 11 measures an intensity of the ambient sound.

The processor 14 receives the intensity of ambient sound from the noise assessment unit 11 and compares it with a given threshold at step S20*b*. If the intensity of ambient sound is equal to or higher than the given threshold, the operation proceeds to step S30*s*. If the intensity of ambient sound is lower than the given threshold, the operation proceeds to step S40*s*.

At step S30*b*, the processor 14 sets the omnidirectional audio output level to a high-level VOL_HIGH. Alternatively, at step S40*b*, the processor 14 sets the omnidirectional audio output level to a low-level VOL_LOW.

Then, at step S50*b*, the processor 14 drive the omnidirectional speaker 15 to reproduce the sound content at the omnidirectional audio output level. Simultaneously, the processor 14 drives the directional speaker 16 so as to transmit the sound content in a form of a directed beam of ultrasound waves. In this way, only a person in the specific area to which the directional speaker 16 is oriented can recognize the sound content and people outside the specific area cannot listen the sound content.

It has been reported that the audibility and auditory sensitivity depend on age, gender and the like. Thus, the extracted attributes may also be used to correct the threshold and/or output levels of the speakers to effectively deliver the sound contents.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution.

For example, the above-discussed embodiments may be stored in computer readable non-transitory storage medium as a series of operations or a program related to the operations that is executed by a computer system or other hardware capable of executing the program. The computer system as used herein includes a general-purpose computer, a personal computer, a dedicated computer, a workstation, a PCS (Personal Communications System), a mobile (cellular) telephone, a smart phone, an RFID receiver, a laptop computer, a tablet computer and any other programmable data processing device. In addition, the operations may be performed by a dedicated circuit implementing the program codes, a logic block or a program module executed by one or more processors, or the like. Moreover, the sound reproducing apparatus 10 including the network interface 12 has been described. However, the network interface 12 can be removed and the sound reproducing apparatus 10 may be configured as a standalone apparatus.

The actual scope of the protection sought is intended to be defined in the following claims when viewed in their proper perspective based on the prior art.

The invention claimed is:

1. A sound reproducing apparatus comprising:

a noise assessment unit configured to assess an intensity of ambient sound;

a processor that determines an omnidirectional audio output level based on the intensity of ambient sound;

an omnidirectional speaker configured to reproduce a desired sound at the omnidirectional audio output level; and a directional speaker configured to reproduce the desired sound simultaneously with the omnidirectional speaker, wherein the processor extracts attribute information of the listener from the image and determines contents of the desired sound based on the extracted attribute information.

2. The sound reproducing apparatus according to claim 1, wherein the noise assessment unit includes a microphone.

3. The sound reproducing apparatus according to claim 1, wherein the noise assessment unit includes statistical data of the intensity of ambient sound and estimates the intensity of ambient sound by looking up the statistical data.

4. The sound reproducing apparatus according to claim 1, further comprising a communication module configured to be connected to a network.

5. The sound reproducing apparatus according to claim 4, wherein audio data of the desired sound is streamed from the network via the communication module.

6. The sound reproducing apparatus according to claim 1, wherein the processor compares the intensity of ambient sound with a given threshold to select one of at least two different omnidirectional audio output levels.

7. The sound reproducing apparatus according to claim 6, wherein the extracted attributes are used to correct the threshold.

8. A sound reproducing method comprising:

assessing an intensity of ambient sound;

determining an omnidirectional audio output level based on the intensity of ambient sound;

reproducing a desired sound simultaneously from an omnidirectional speaker and a directional speaker;

capturing an image of a listener with a camera;

extracting attribute information of the listener from the image; and determining contents of the desired sound based on the extracted attribute information, wherein the omnidirectional speaker is controlled to reproduce the desired sound at the omnidirectional audio output level.

9. The sound reproducing method according to claim 8, wherein the step of assessing an intensity of ambient sound comprises collecting the ambient sound with a microphone.

10. The sound reproducing method according to claim 8, wherein the step of assessing an intensity of ambient sound comprises looking up statistical data of the intensity of ambient sound.

11. The sound reproducing method according to claim 8, wherein audio data of the desired sound is streamed from a network.

12. The sound reproducing method according to claim 8, wherein the step of determining an omnidirectional audio output level comprises comparing the intensity of ambient sound with a given threshold to select one of at least two different omnidirectional audio output levels.

13. The sound reproducing method according to claim 12, wherein when the intensity of ambient sound is equal to or higher than the given threshold, the omnidirectional audio output level is set to a high-level.

14. The sound reproducing method according to claim 12, wherein when the intensity of ambient sound is lower than the given threshold, the omnidirectional audio output level is set to a low-level.

15. The sound reproducing method according to claim 12, further comprising:

correcting the threshold based on the extracted attributes.

16. A computer readable non-transitory storage medium storing a program that, when executed by a computer, cause the computer to perform operations comprising:

assessing an intensity of ambient sound;

determining an omnidirectional audio output level based on the intensity of ambient sound;

reproducing a desired sound simultaneously from an omnidirectional speaker and a directional speaker;

capturing an image of a listener with a camera;

extracting attribute information of the listener from the image; and determining contents of the desired sound based on the extracted attribute information, wherein the omnidirectional speaker is controlled to reproduce the desired sound at the omnidirectional audio output level.

* * * * *